US008985715B2

(12) United States Patent
Merz et al.

(10) Patent No.: US 8,985,715 B2
(45) Date of Patent: Mar. 24, 2015

(54) DISHWASHER, ESPECIALLY DOMESTIC DISHWASHER

(75) Inventors: Reinhard Merz, Furth (DE); Erika Nell, Oberasbach (DE)

(73) Assignee: Electrolux Home Products Corporation, Brussels (BE)

( * ) Notice: Subject to any disclaimer, the term of this patent is extended or adjusted under 35 U.S.C. 154(b) by 0 days.

(21) Appl. No.: 13/635,543

(22) PCT Filed: Mar. 16, 2011

(86) PCT No.: PCT/EP2011/001294

§ 371 (c)(1),
(2), (4) Date: Sep. 17, 2012

(87) PCT Pub. No.: WO2011/113585

PCT Pub. Date: Sep. 22, 2011

(65) Prior Publication Data

US 2013/0009530 A1 Jan. 10, 2013

(30) Foreign Application Priority Data

Mar. 18, 2010 (EP) ..... 10002837

(51) Int. Cl.
*A47B 77/08* (2006.01)
*A47L 15/50* (2006.01)

(52) U.S. Cl.
CPC ..... *A47L 15/50* (2013.01); *A47L 15/507* (2013.01)
USPC ..... 312/228.1; 312/296; 312/311; 312/323; 211/41.8

(58) Field of Classification Search
USPC ..... 312/228, 228.1, 296, 311, 310, 309, 312/322, 323, 334.44; 211/418, 419, 41.8, 211/41.9; 134/134, 135
See application file for complete search history.

(56) References Cited

U.S. PATENT DOCUMENTS 2,534,100 A * 12/1950 Baumgartner ..... 220/345.4
3,072,452 A * 1/1963 Sleeper ..... 312/228

(Continued)

FOREIGN PATENT DOCUMENTS

| | | | |
|---|---|---|---|
| CA | 2 358 976 | A1 | 4/2002 |
| CN | 1464161 | A | 12/2003 |
| DE | 200 22 478 | U1 | 10/2001 |

OTHER PUBLICATIONS

At the rear edge of the lower crockery basket, two vertical struts (one on each side of the basket) extend below the basket forming a stop. When extracted from the dishwasher body, the lower basket is thus limited from being extracted too far by the two stops catching on the lower edge of the opened, Oct. 1, 2002, XP009137150, Retrieved from the Internet: www.manualshark.org/p/aeg-6/aeg-favorit-6069-w-7408, retrieved Aug. 3, 2010.

(Continued)

*Primary Examiner* — Daniel Rohrhoff
(74) *Attorney, Agent, or Firm* — Alston & Bird LLP

(57) ABSTRACT

The invention relates to a dishwasher (1), in particular to a domestic dishwasher, having a washing cavity (2) in which at least one crockery basket (3) is arrangable, wherein the at least one crockery basket (3) can be moved forth and back between an inserted position and a pull out position, wherein a door (4) is arranged at the front side (5) of the dishwasher (1) which can be arranged in an open (0) and in a closed (C) position and wherein means (6) are arranged to prevent that the crockery basket (3) is pulled out of the washing cavity (2) too far, wherein the means (6) comprise at least one hook element (7) which is firmly connected with the crockery basket (3), wherein the at least one hook element (7) is designed to cooperate with a stop element (8) which is formed at or in a lower edge (15) of the door (4) or at or in an adjacent part (12) of a lower edge (15) of the door (4), preferably wherein the at least one hook element (7) is designed to grip below said stop element (8).

12 Claims, 5 Drawing Sheets

(56) References Cited

U.S. PATENT DOCUMENTS

Figure 1:
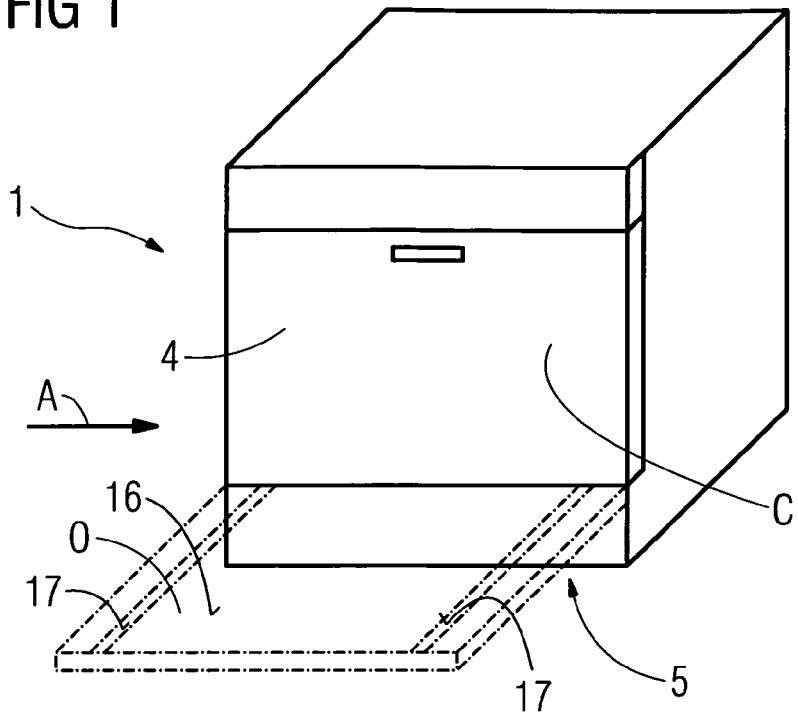

| | | | | |
|---|---|---|---|---|
| 3,228,739 | A | 1/1966 | Fay et al. | |
| 3,347,613 | A * | 10/1967 | Krzewina | 312/333 |
| 3,397,001 | A * | 8/1968 | Friedman | 292/87 |
| 4,505,526 | A * | 3/1985 | Leck | 312/333 |
| 5,445,451 | A * | 8/1995 | Harmony | 312/333 |
| 7,001,004 | B2 * | 2/2006 | Bartloff et al. | 312/334.45 |
| 7,232,195 | B2 * | 6/2007 | Yang | 312/333 |
| 2009/0151758 | A1 * | 6/2009 | Kristensson et al. | 134/201 |
| 2010/0066221 | A1 * | 3/2010 | Hakemann | 312/296 |
| 2013/0093303 | A1 * | 4/2013 | Carr et al. | 312/228.1 |

OTHER PUBLICATIONS

International Search Report for Application No. PCt/EP2011/001294 dated Feb. 2, 2012.

AEG Hausgeräte GMBH, "Öko_Favorit 2030/3220 i, Dishwasher, Operating Instructions", copyright 1995, 42 pages, Germany.

AEG-Kundendienst, "G 06 Favorit 3030-w E-Nr. 911 232 001" (Parts Diagram), 04.95 HV83-N, Apr. 1995, 1 page, Germany.

English Translation (Machine) of CN1464161A to Jiang Fangbing.

State Intellectual Property Office of the People's Republic of China, Notification of the Second Office Action for Application 2011800142331, Jan. 19, 2015, 8 pages, China. English Translation only.

* cited by examiner

DISHWASHER, ESPECIALLY DOMESTIC DISHWASHER

CROSS REFERENCE TO RELATED APPLICATIONS

This application is a national stage application filed under 35 U.S.C. 371 of International Application No. PCT/EP2011/001294, filed Mar. 16, 2011, which claims priority from European Patent Application No. 10002837.2, filed Mar. 18, 2010, each of which is incorporated by reference herein in its entirety.

The invention relates to a dishwasher, especially to a domestic dishwasher, having a washing cavity in which at least one crockery basket is arrangable, wherein the at least one crockery basket can be moved forth and back between an inserted position and a pull out position, wherein a door is arranged at the front side of the dishwasher which can be arranged in an open and in a closed position and wherein means are arranged to prevent that the crockery basket is pulled out of the washing cavity too far.

A dishwasher of this kind is disclosed in DE 200 22 478 U1. A crockery basket is here arranged in the washing cavity. The crockery basket carries the dishes during the washing operation. To load and to unload the crockery basket with dishes the basket can be arranged in an inserted position (washing position) in the cavity and in a pull out position for loading and unloading.

The mentioned document takes already measures to prevent that the crockery basket is pulled out too far off the washing cavity, i.e. means are provided to prevent that the basket is pulled out of the washing cavity too far. Those means are designed as a flexible band which is connected with the crockery basket with one end and with the inside of the cavity with the other end.

It is a drawback of this solution that the means for preventing that the basket is pulled out of the washing cavity too far are quite complex and thus costly.

Furthermore, it is an unsolved problem that the crockery basket can tilt when being pulled out from the washing cavity.

Therefore, it is an object of the invention to propose a dishwasher of the generic kind which overcomes the mentioned disadvantages. Consequently, a sure mechanism is aimed which secures that the crockery basket cannot be pulled out from the washing cavity too far. Furthermore, measures should be taken that any tilting of the crockery basket is prevented when being in the pull out position.

According to a first aspect of the present invention, the solution of this object is characterized in that the means for preventing that the crockery basket is pulled out of the washing cavity too far comprise at least one hook element which is firmly connected with the crockery basket, wherein the at least one hook element is designed to cooperate with a stop element which is formed at or in a lower edge of the door or at or in an adjacent part of a lower edge of the door, preferably wherein the at least one hook element is designed to grip below said stop element.

Herein, the hook element that grips below the stop element shall be intended to mean in general that the lower end of the hook element can enter into gripping engagement with the lower edge of the door or with an adjacent part of the lower edge of the door, wherein said lower edge of the door or said adjacent part thereof basically forms a stop for the hook element and—as the hook element is connected with the crockery basket—also forms a stop for the pull-out movement of the crockery basket out of the washing cavity, wherein the gripping engagement of the hook with the lower edge of the door or with an adjacent part thereof provides a save stop even against an inadvertently strong pull-out movement applied by a user to the crockery basket.

The at least one hook element is preferably arranged at the rear end of the crockery basket in order to inhibit pulling the crockery basket too far out of the washing cavity. The at least one hook element preferably extends downwardly below a first and/or second rail element for guiding the crockery basket in order to allow a gripping interaction of the hook element with a lower edge of the door. The hook element can be bent in such a way that its free end can be inserted at least partially into a recess that is formed at the lower edge of the door. The hook element can have a cross section that corresponds to a recess that is formed at the lower edge of the door, at least in that region of the hook element which is designed to be inserted into said recess.

Preferably, two hook elements are arranged at the crockery basket for avoiding a sideward movement of the crockery basket when the hook elements stop the pull out movement of the crockery basket. Two hook elements can be arranged in opposite side regions of the crockery basket. The two hook elements can be arranged symmetrically to a middle plane extending vertically through the middle of the dishwasher.

The stop element is preferably formed at a lower edge of the door, wherein particularly the stop element can be formed by the lower edge of the door. The lower edge of the door can be formed by the lower edge of the inner wall of the door that is bent outwardly with respect to the washing cavity of the dishwasher.

Furthermore, the stop element can comprises a recess which is designed for insertion of the end of the hook element.

The recess can be formed by both of the lower edge of the door and an elastic sealing element, which is arranged at the lower edge of the door. The sealing element is preferably of the type that is allows to seal the door against leakage of water from the bottom region of the washing cavity.

The stop element can be formed at a face side of the door. Here, a stop can be formed at the face side of the door to form the stop element.

An alternative embodiment proposes that the stop element is formed at an apron element of the door. This element is regarded within this proposal to be an adjacent part of the door.

The stop element can comprise a recess which is designed for insertion of the end of the hook element. The recess can have a circular cross section. Furthermore, it is possible that the hook element is bent in such a way that its free end at least partially can be inserted into the recess. In this context it is further preferred that the hook element and the recess have corresponding cross sections at least in that region of the hook element which is designed to be inserted into the recess. Any tilting of the crockery basket is thus prevented.

The stop element is preferably brought prime into the operation position when the door is opened.

The hook element cooperates with the stop element preferably with an undercut configuration; hook element and stop element cooperate in a form fit manner.

Preferably the door is hinged around a horizontal pivot axis which is provided in the region of the lower end of the door, wherein the door in its open position being oriented essentially horizontally and the crockery basket can be moved to a pulled-out position, in which the crockery basket rests on an inner wall of the door.

The crockery basket can comprises guiding rolls (wheels) and can be thus be movable on first rail elements which are provided inside the washing cavity and on second rail elements which are formed on the inner wall of the door, wherein the first and second rail elements are preferably arranged in essentially the same horizontal plane when the door is in its open position.

The crockery basket is preferably arranged in the bottom region of the washing cavity; a second crockery basket can be arranged above the crockery basket.

According to a second aspect of the invention it is dealing with a solution by which it is made sure that the crockery basket cannot tilt along a horizontal transverse axis even e.g. if it is loaded in its rear part with heavy plates or the like.

If the crockery basket is loaded in the mentioned rear part with heavy dished or the like and the crockery basket is not sufficiently supported on its rail elements the problem occurs that the mentioned tilting movement can take place. This is especially the case when the rear guiding rolls of the crockery basket are in the transition zone between the rail elements in the washing cavity and those on the door inner wall. In this case the rear guiding rolls have no support and the tiling movement can occur.

Tilting of the crockery basket can be avoided according to said second aspect of the invention in that at least one rod element, that preferably can be a favourable embodiment of the aforementioned hook element of the first aspect of the invention, extends down from the rear end of the crockery basket to a vertical position wherein its lower end is adjacent to a bottom plate of the washing cavity and comes into contact with said bottom plate upon a backwards tilting moving of the crockery basket around a horizontal transverse axis in order to prevent a further backward tilting.

In other word, the at least one rod element forms a support element for the crockery basket which is supporting the rear part of the crockery basket in such a way that tilting of the crockery basket around a horizontal transverse axis is prevented.

The rod element is made preferably from the wire material from which the crockery basket is normally made. It can be welded or soldered with the crockery basket or can be formed during the production of the crockery basket. As already said, the rod element can be the hook element of the first aspect of the invention that has a suitable length downwards to come into contact with said bottom plate upon a backwards tilting moving of the crockery basket in order to prevent a further backward tilting of the crockery basket.

By the proposed design of the dishwasher it becomes possible to surely prevent that the crockery basket is pulled out from the washing cavity too far. At the same time measures are taken, that any tilting movement of the crockery basket in the pull out position is securely prevented. To the contrary, the crockery basket gets a firm hold in the pull out position so that the loading and the unloading of the basket can take place under optimized circumstances.

Thus, the hook element and or the rod element of the invention provide a security facility for the crockery basket. Preferably, the hook element has thus a double function: Any pulling out of the crockery basket to a too far position is prevented. At the same time backward tilting of the basket is prevented.

In the drawings embodiments of the invention are depicted.

Figure 2:
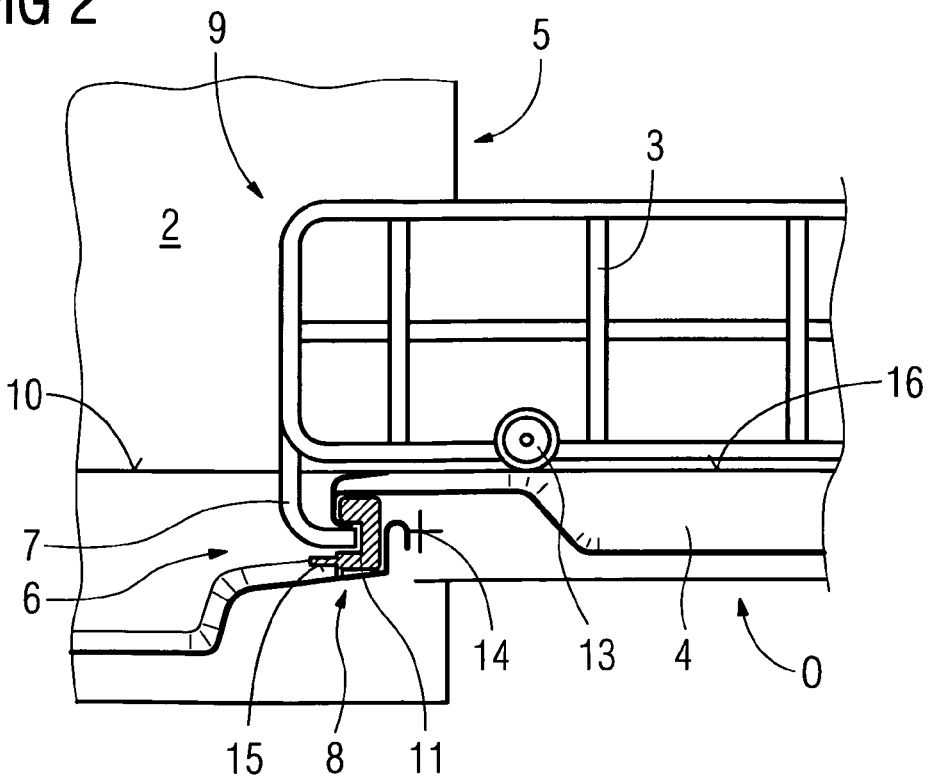
Figure 3:
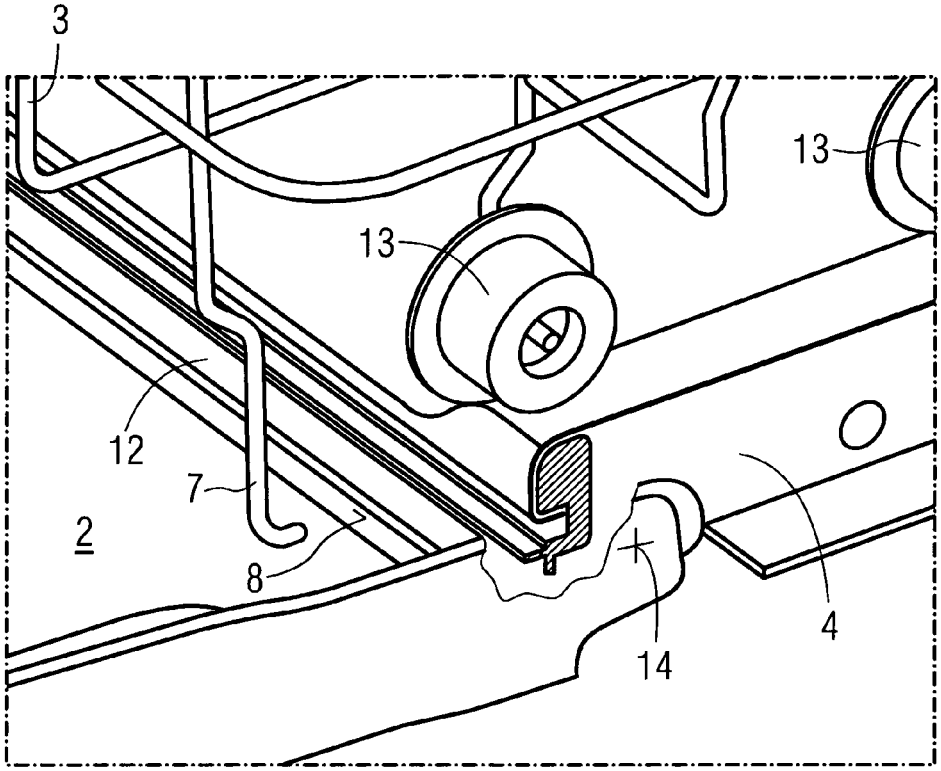
Figure 4:
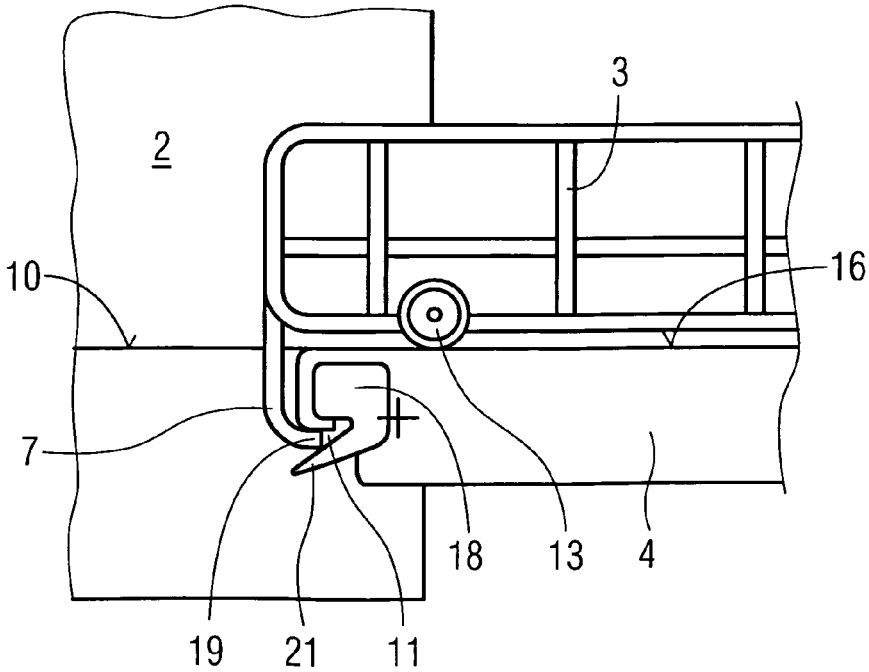
Figure 5:
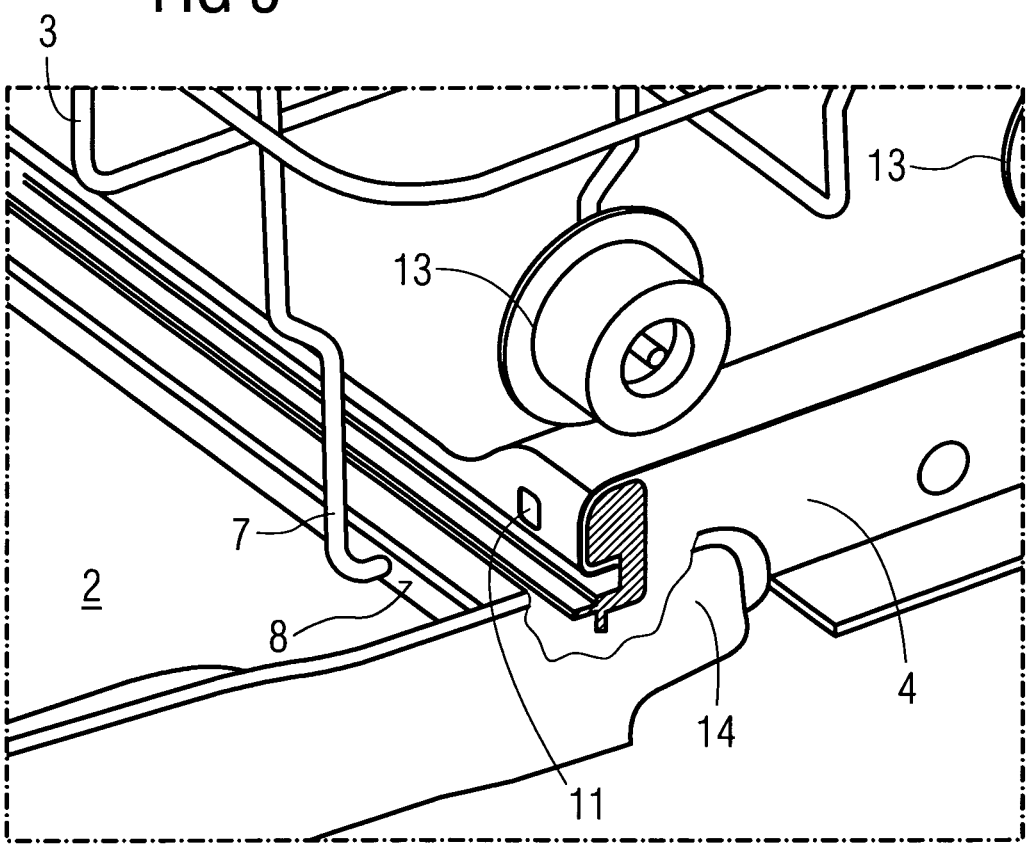
Figure 6:
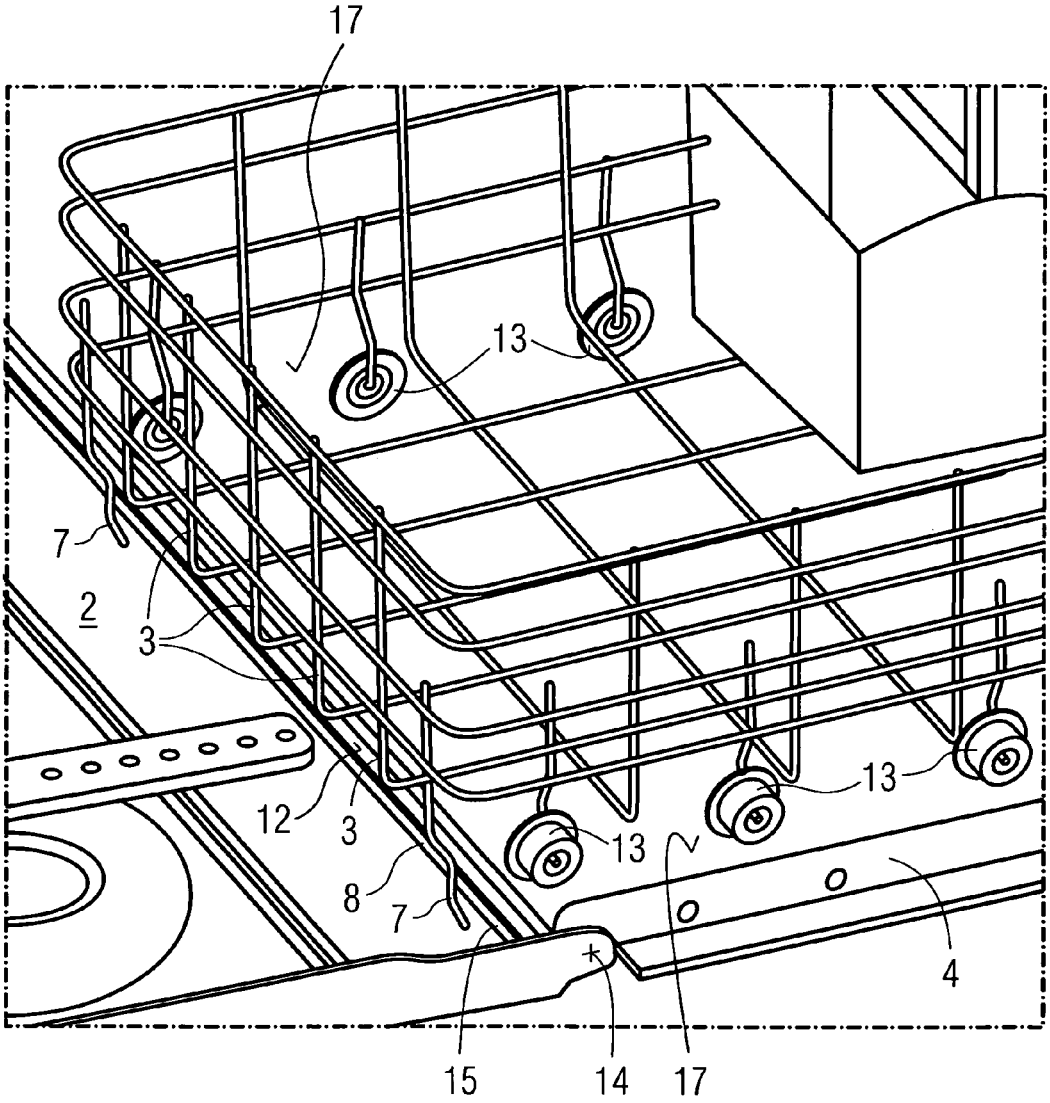
Figure 7:
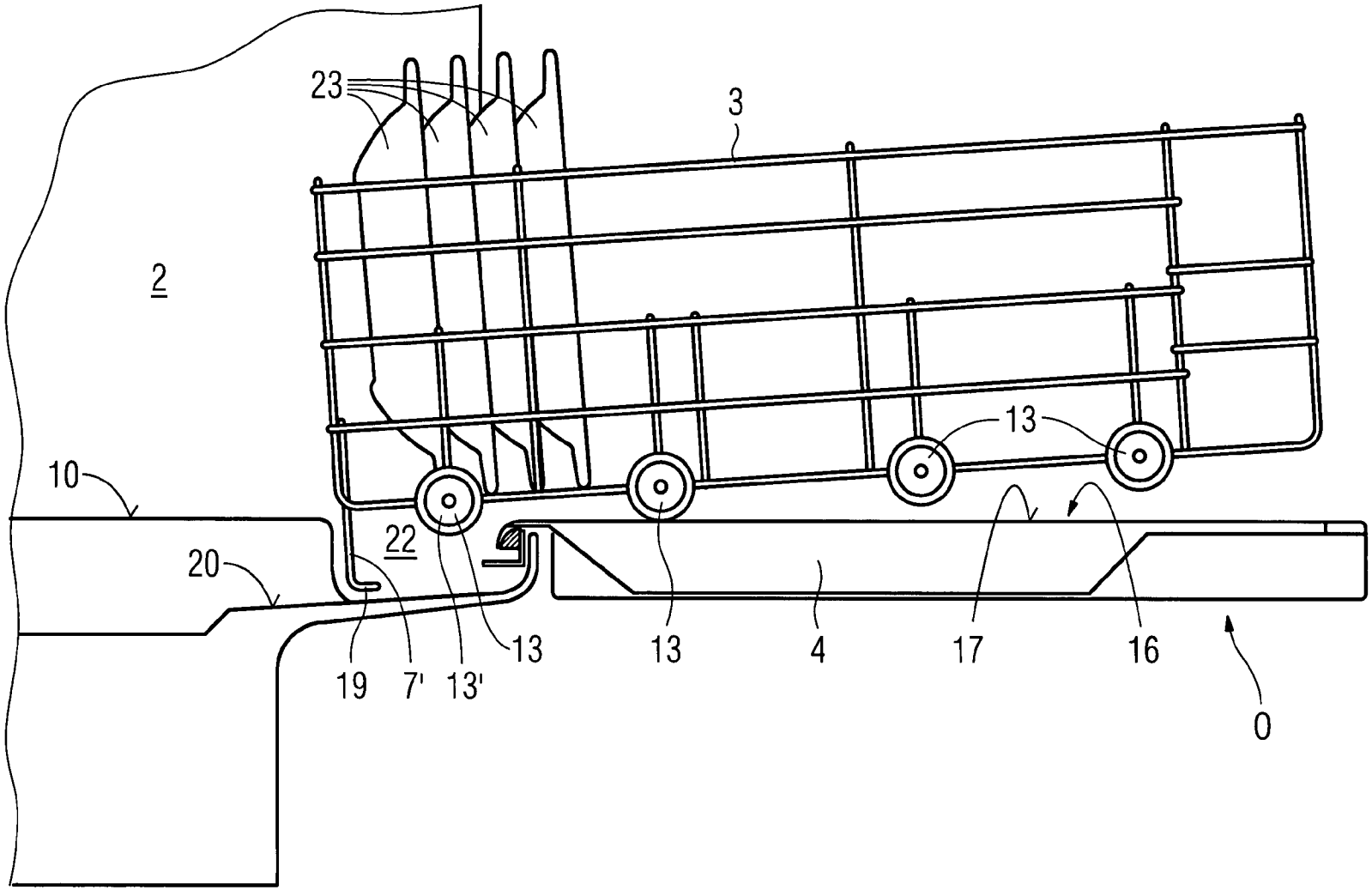

FIG. 1 shows a perspective view of a domestic dishwasher,

FIG. 2 shows a sectional view through a part of the dishwasher seen in direction of arrow "A" according to FIG. 1 and showing a first embodiment of the first aspect of the invention, FIG. 3 shows a perspective view of a part of the dishwasher according to the embodiment of FIG. 2, FIG. 4 shows a sectional view of a second embodiment of the dishwasher of FIG. 2, FIG. 5 shows a perspective view of a third embodiment of the first aspect of the invention, FIG. 6 shows a perspective view of a fourth embodiment of the first aspect of the invention and FIG. 7 shows a sectional view through a part of the dishwasher, seen in direction of arrow "A" according to FIG. 1 according to the second aspect of the invention.

In FIG. 1 a dishwasher 1 is shown. The dishwasher 1 has a door 4 at its front side 5. The door can be positioned in two positions: In the closed position C (shown with regular lines) the washing cavity 2 (see FIG. 2) of the dishwasher is closed. In the opened position O (shown with dashed lines in FIG. 1) the cavity of the dishwasher 1 is accessible. In this position a crockery basket can be pulled out of the washing cavity to load or to unload the basket with dishes.

In FIG. 2 details of a first embodiment of the first aspect of the dishwasher 1 of the invention are shown. Here a part of the dishwasher 1 is shown, seen in a partial cross section and in the direction of the arrow "A" of FIG. 1.

A crockery basket 3 is arranged in the dishwasher 1. The crockery basket 3 can be placed completely within the washing cavity 2 and the door 4 can be closed in this position. For loading or unloading of the crockery basket 3 with dishes the basket 3 can be pulled out of the washing cavity 2 as shown in FIG. 2. Here, almost the end position is shown to which the basket 3 can be pulled out of the cavity 2.

For a frictionless motion of the crockery basket 3 guiding rolls or wheels 13 are arranged at the basket 3 which can roll on first rail elements 10 in a known manner. For pulling out of the crockery basket 3 the door 4 must be in the open position O as shown in FIG. 2. For opening the door 4 it can be pivoted around the pivot axis 14. At the inner wall 16 of the door 4 second rail element 17 are arranged as schematically shown in FIG. 1. When the door 4 is in its open position O the first and second rails 10, 17 are arranged in substantial a common plane to form a track for the crockery basket 3 when it is pulled out of the washing cavity 2.

To prevent that the crockery basket 3 is pulled out too far from the cavity 2 and also to ensure that any tiling of the basket 3 is avoided the following arrangement is proposed:

Means 6 are arranged which ensure the mentioned function. Those means 6 comprise two hook elements 7 in the present embodiment which are firmly connected with the crockery basket 3. The two hook elements 7 are designed to cooperate with a stop element 8 which is formed at or in the lower edge 15 of the door 4 or at or in an adjacent part 12 of the door.

In FIG. 2 the two hook elements (only one hook element is depicted in FIG. 2) are arranged at the rear end 9 of the crockery basket 3 in the lateral sides of the basket 3. The free ends of the hook elements 7 are bent in such a way that they at least partially point in the pulling direction when the crockery basket 3 is pulled out of the dishwasher 1. The stop element 8 is realized by a recess 11 which is machined into the lower edge 15 of the door 4. When the door 4 is in its open position O the recess 11 is in a position to receive the end of the hook element 7 as shown in FIG. 2.

When the crockery basket 3 has reached the furthermost position outside the washing cavity 2—in FIG. 2 almost this position is shown—the hook elements 7 enter into the recesses 11 and thus make sure that a stop for the pull out movement is given and that the crockery basket 3 finds a hold in the door 4 so that not tilting of the basket 3 can take place.

FIG. 3 shows a perspective view of the dishwasher according FIG. 2. It is to be noted that the crockery basket 3 is shown in its outermost position in FIG. 2 while this position is not yet reached in FIG. 3.

Alternative embodiments of the first aspect of the invention are depicted in FIG. 4, FIG. 5 and FIG. 6. Here a part of the washing cavity 2 and of the crockery basket 3 can be seen (in a sectional view in FIG. 4 and in perspective views in FIG. 5 and FIG. 6).

The hook element 7 extends downwardly from the crockery basket below the level of the rail element like in the case of FIG. 2.

The free end of the hook element 7 is bent and is directed substantially in horizontal direction (FIG. 4 and FIG. 5) or is slightly bent only (FIG. 6).

In FIG. 4 it can be seen that a sealing element 18 is arranged in the bottom side of the door 4 (the sealing element is running around the whole circumference of the door 4 to seal the door 4 against the washing cavity 2 of the dishwasher 1). The sealing element 18 forms a sealing lip 21 which is protruding into the direction of the washing cavity 2 when the door 4 is in its open position. So, a recess 11 is formed which serves for the entry of the end 19 of the hook element 7 when the crockery basket 3 is pulled out of the washing cavity 2. The effect is the same as explained in connection with FIG. 2.

In FIG. 5 an alternative is shown: Here a recess 11 is arranged in the lower edge of the door. Thus, when the crockery basket 3 reaches its furthermost position the end of the hook element 7 is introduced into the recess 11.

In FIG. 6, the stop element 8 is realized by an apron element 12 of the door 4 which defines a step against which the end of the hook element 7 strikes when reaching the furthermost outer position.

In any case the proposed design makes sure that the crockery basket 3 cannot be pulled out of the washing cavity 2 too far, because of the gripping engagement of the hook element 7 with the recess 11 in the lower edge of the door, or respectively with the apron element 12 of the door, which provides a save stop even against an inadvertently strong pull-out movement applied by the user to the basket. Furthermore, no tilting can take place when the basket 3 is in the furthermost outer position.

It is to be noted that the crockery basket 3 is shown in its outermost position in FIG. 4 while this position is not yet (completely) reached in FIG. 5 and FIG. 6.

Beneficially, the realization of the proposed design can be done in a very cost efficient manner.

In FIG. 7 a second aspect of the invention is depicted. Here a rod element 7' (which is very similar to the hook element 7 according to the solutions as described above and which is also fixed at the crockery basket 3) is extended downwards until the end 19 of the rod element 7' reaches a bottom plate 20 of the washing cavity 2.

By this design it is prevented that the crockery basket 3 can tilt around a horizontal axis which is perpendicular to the drawing plane of FIG. 7 in a counter-clockwise direction which could otherwise be the case if the crockery basket is loaded in its rear part with heavy dished and the crockery basket 3 is not sufficiently supported on its rail elements 10, 16. This can be specifically the case when the guiding rolls 13 are in the transition zone between the rail elements 10 and 16.

This position is shown in FIG. 7. As can be seen here the guiding roll 13' of the crockery basket 3 is just above the gap 22 which is formed between the first rail element 10 in the washing cavity 2 and the second rail element 17 which is formed at the inner wall 16 of the door 4. As can be seen in FIG. 7 the crockery basket 3 is loaded only in its rear part with plates 23, so that there is a trend for tiling of the crockery basket 3 as indicated in FIG. 7.

In this situation the rod element 7' supports the crockery basket 3 by contacting the bottom plate 20 of the washing cavity 2.

Preferably, the length of the rod element 7' is selected in such a way that the end 19 of the rod element 7' is during intended use between 0 mm and 5 mm above the bottom plate 20 of the washing cavity 2. If the crockery basket 3 is loaded heavily in its rear part (as shown in FIG. 7) the rod element 7' supports the crockery basket 3 when it is moved back and forth out from and into the washing cavity. So, any tiling movement is prevented or at least aggravated.

Of course, the above explained function of the rod element 7' is also maintained in this embodiment: The rod element 7' can run against or below the lower edge (face side) 15 of the door 4 when it is in its open position O to form a stop for the movement of the crockery basket 3.

REFERENCE NUMERALS

1 Dishwasher
2 Washing Cavity
3 Crockery Basket
4 Door
5 Front Side
6 Means for Preventing Pull Out
7 Hook Element
7' Rod Element
8 Stop Element
9 Rear End
10 First Rail Element
11 Recess
12 Apron Element
13, 13' Guiding Roll (wheel)
14 Pivot Axis
15 Lower Edge (face side)
16 Inner Wall
17 Second Rail Element
18 Sealing Element
19 End of the Rod Element
20 Bottom Plate
21 Sealing Lip
22 Gap
23 Plate
O Open Position
C Closed Position

The invention claimed is:

1. Dishwasher having a washing cavity in which at least one crockery basket is arrangable, wherein the at least one crockery basket can be moved forth and back between an inserted position and a pull out position, wherein a door is arranged at a front side of the dishwasher which can be arranged in an open and in a closed position and wherein means are arranged to prevent that the crockery basket is pulled out of the washing cavity too far, wherein the means comprise at least one hook element which is firmly connected with the crockery basket, wherein the at least one hook element is designed to cooperate with a stop element which is formed at or in a lower edge of the door or at or in an adjacent part of a lower edge of the door, wherein the at least one hook element is designed to grip below said stop element;

wherein the hook element defines a free end and is bent in such a way that the free end can be inserted at least partially into a recess that is formed at the lower edge of the door; and wherein the recess is formed by both of the lower edge of the door and an elastic sealing element, which is arranged at the lower edge of the door.

2. Dishwasher according to claim 1, wherein the at least one hook element is arranged at a rear end of the crockery basket.

3. Dishwasher according to claim 1, wherein the at least one hook element extends downwardly below a first and/or second rail element for guiding the crockery basket.

4. Dishwasher according to claim 1, wherein the stop element is formed by the lower edge of the door.

5. Dishwasher according to claim 1, wherein the stop element comprises the recess which is designed for insertion of the end of the hook element.

6. Dishwasher according to claim 1, wherein the hook element and the recess have corresponding cross sections at least in that region of the hook element which is designed to be inserted into the recess.

7. Dishwasher according to claim 1, wherein two hook elements are arranged in opposite side regions of the crockery basket.

8. Dishwasher according to claim 7, wherein the two hook elements are arranged symmetrically to a middle plane extending vertically through a middle of the dishwasher.

9. Dishwasher according to claim 1, wherein the door is hinged around a horizontal pivot axis which is provided in a region of a lower end of the door, wherein the door in its open position being oriented essentially horizontally and the crockery basket can be moved to a pulled-out position, in which the crockery basket rests on an inner wall of the door.

10. Dishwasher according to claim 1, wherein the crockery basket comprises guiding rolls and is movable on first rail elements which are provided inside the washing cavity and on second rail elements that are formed on an inner wall of the door, wherein the first and second rail elements are arranged in essentially the same horizontal plane when the door is in its open position.

11. Dishwasher according to claim 1, wherein the crockery basket is arranged in a bottom region of the washing cavity.

12. Dishwasher according to claim 1, wherein the at least one hook element extends down from a rear end of the crockery basket to a vertical position wherein its lower end is adjacent to a bottom plate of the washing cavity of the dishwasher.

* * * * *

UNITED STATES PATENT AND TRADEMARK OFFICE

CERTIFICATE OF CORRECTION

PATENT NO. : 8,985,715 B2
APPLICATION NO. : 13/635543
DATED : March 24, 2015
INVENTOR(S) : Merz et al.

It is certified that error appears in the above-identified patent and that said Letters Patent is hereby corrected as shown below:

Title Page

"(73) Assignee: Electrolux Home Products Corporation" should read

--(73) Assignee: Electrolux Home Products Corporation N.V.--

Signed and Sealed this
Eighth Day of September, 2015

Michelle K. Lee

Michelle K. Lee
*Director of the United States Patent and Trademark Office*